US006861922B2

(12) United States Patent
Hasegawa

(10) Patent No.: US 6,861,922 B2
(45) **Date of Patent: *Mar. 1, 2005**

(54) NONRECIPROCAL CIRCUIT DEVICE INCLUDING TWO SERIES RESONANT CIRCUITS HAVING DIFFERING RESONANT FREQUENCIES

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 109 days.

This patent is subject to a terminal disclaimer.

(21) Appl. No.: 09/798,332

(22) Filed: Mar. 2, 2001

(65) Prior Publication Data

US 2002/0024400 A1 Feb. 28, 2002

(30) Foreign Application Priority Data

Mar. 2, 2000 (JP) ..... 2000-057710
May 25, 2000 (JP) ..... 2000-155378

(51) Int. Cl.[7] ..... H01P 1/36
(52) U.S. Cl. ..... 333/24.2; 333/1.1
(58) Field of Search ..... 333/1.1, 24.2, 333/176; H01P 1/36, 1/303

(56) References Cited

U.S. PATENT DOCUMENTS

| | | | | | |
|---|---|---|---|---|---|
| 3,895,320 | A | | 7/1975 | Katoh | 333/1.1 |
| 4,236,125 | A | * | 11/1980 | Bernard et al. | 333/1.1 |
| 5,495,210 | A | | 2/1996 | Forterre et al. | 333/1.1 |
| 5,619,080 | A | * | 4/1997 | Pennington et al. | 333/176 |
| 6,020,793 | A | * | 2/2000 | Makino et al. | 333/1.1 |
| 6,639,485 | B2 | * | 10/2003 | Hasegawa et al. | 333/24.2 |
| 2001/0020877 | A1 | * | 9/2001 | Hasegawa et al. | 333/1.1 |

FOREIGN PATENT DOCUMENTS

| | | | | | |
|---|---|---|---|---|---|
| EP | 0 903 802 | A2 | | 3/1999 | |
| EP | 948079 | A1 | * | 10/1999 | H01P/1/203 |
| FR | 2 671 912 | A1 | | 7/1992 | |
| JP | 50-122145 | | | 9/1975 | |
| JP | 56-167617 | | | 4/1981 | |
| JP | 56-123624 | | | 9/1981 | |
| JP | 02-141102 | | | 5/1990 | |
| JP | 7-115306 | | | 5/1995 | |
| JP | 08-023208 | | | 1/1996 | |
| JP | 9-93003 | | | 4/1997 | |
| JP | 10079607 | A | * | 3/1998 | H01P/1/383 |
| JP | 1093308 | | | 10/1998 | |
| JP | 11-239009 | | | 8/1999 | |

OTHER PUBLICATIONS

Krauss et al., "Solid State Radio Engineering", John Wiley & Sons, Inc., 1980, New York NY, p. 39.

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

Three mutually intersecting central conductors are positioned on ferrite to which a direct current magnetic field is applied, the port portions of two of the central conductors are branched and one branched portion of each is extended and bent so as to form an inductor. These inductors and capacitors with one end connected to a ground terminal make up series resonant circuits. The resonance frequencies of the series resonant circuits are set to approximately two times and approximately three times that of the center frequency of the pass band of the device which is the fundamental frequency, thereby causing attenuation of the second harmonic frequency and third harmonic frequency of the fundamental frequency, thus acting as matching capacitance of the fundamental frequency. Accordingly, a small nonreciprocal circuit device having a great amount of attenuation of a particular frequency is obtained without increasing costs, a nonreciprocal circuit device, and a communication device using the same, are provided.

5 Claims, 7 Drawing Sheets

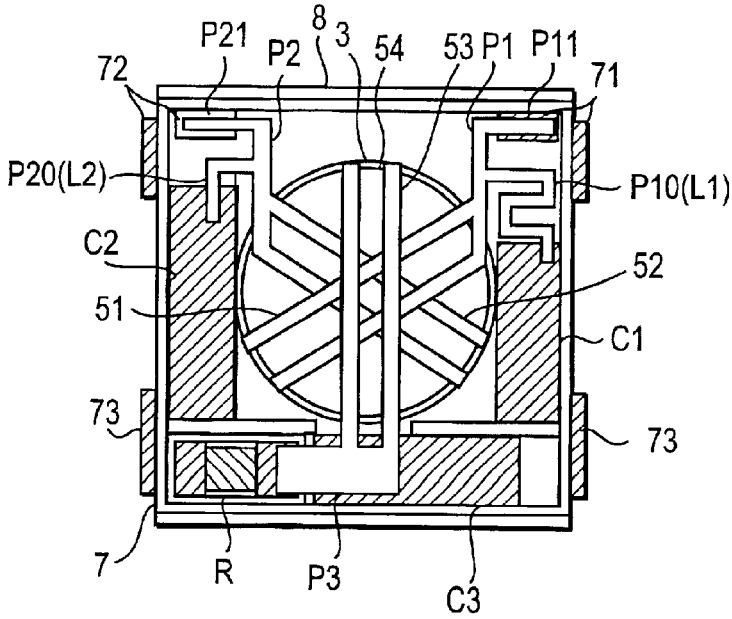
FIG. 2
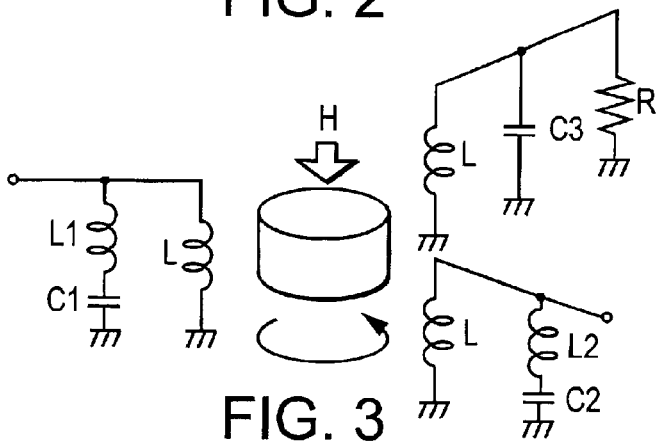
FIG. 3
FIG. 4
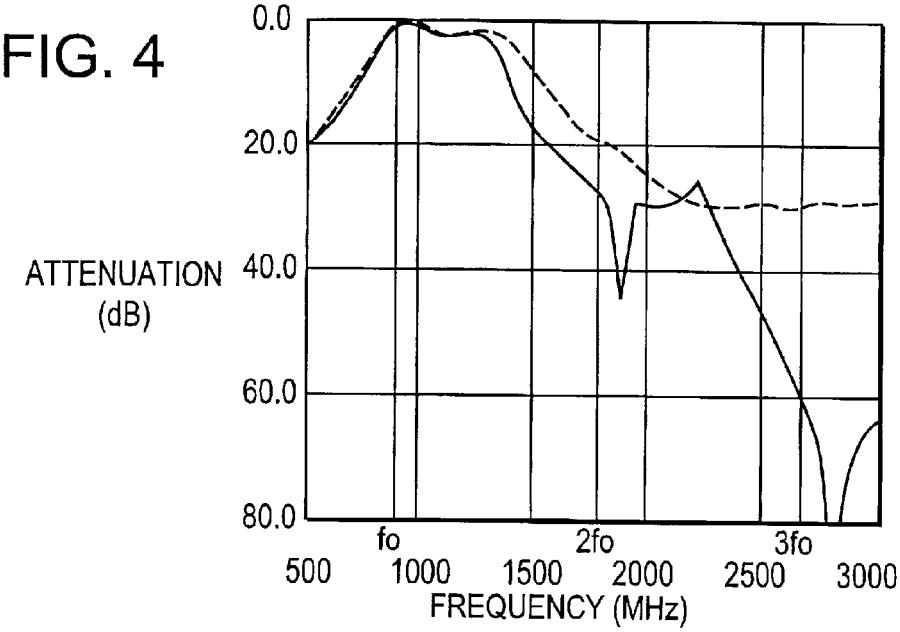

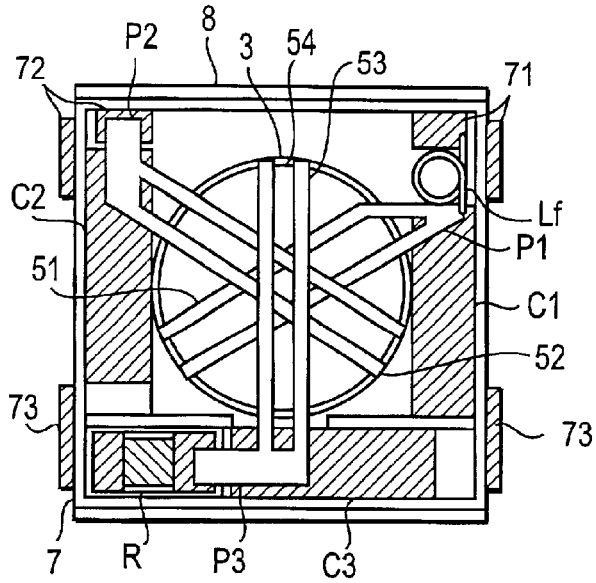
FIG. 11
PRIOR ART
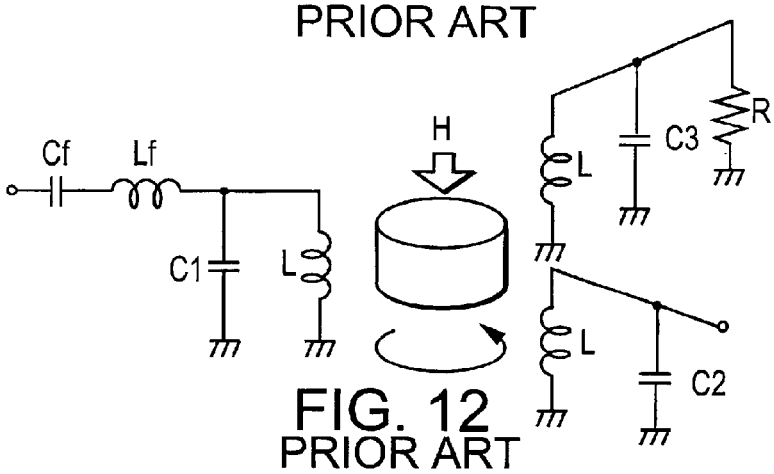
FIG. 12
PRIOR ART
FIG. 13
PRIOR ART
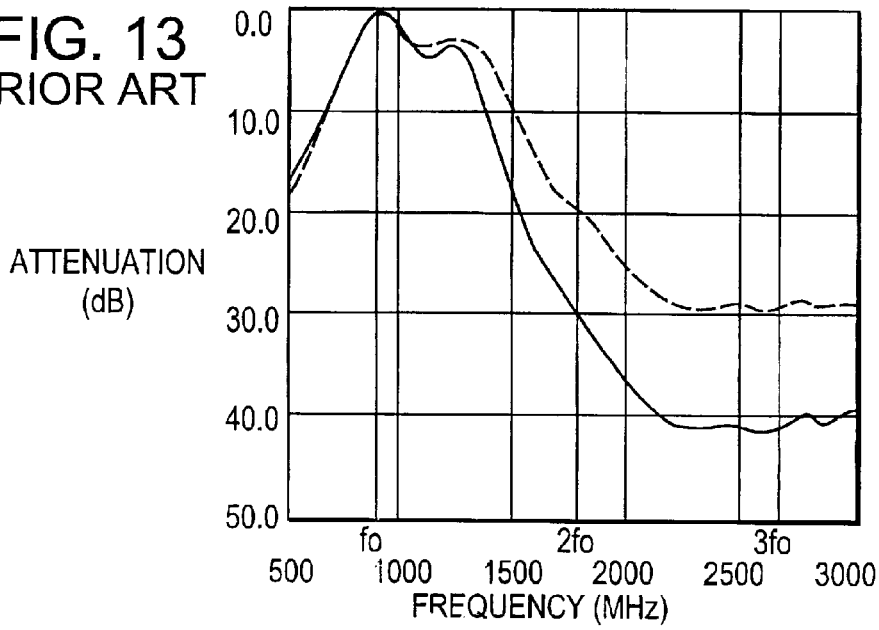

NONRECIPROCAL CIRCUIT DEVICE INCLUDING TWO SERIES RESONANT CIRCUITS HAVING DIFFERING RESONANT FREQUENCIES

BACKGROUND OF THE INVENTION

1. Field of the Invention

The present invention relates to a nonreciprocal circuit device, such as an isolator or circulator or the like used at high-frequency bands such as microwave bands, and to a communication device using the nonreciprocal circuit device.

2. Description of the Related Art

Conventionally, nonreciprocal circuit devices such as lumped parameter isolators and circulators have been widely used for communication devices and the like for ensuring stable operations and protection of oscillators and amplifiers, employing the properties thereof that the amount of attenuation in the sending direction of signals is extremely small and the amount of attenuation in the opposite direction is extremely great.

A exploded perspective view of a conventional isolator is illustrated in FIG. 7 and the internal structure thereof in FIG. 8. FIG. 9 illustrates an equivalent circuit.

As shown in FIGS. 7 and 8, the lumped constant isolator is arranged, within a magnetic closed circuit made up of an upper yoke 2 and lower yoke 8, a magnetic assembly 5 comprising central conductors 51, 52, and 53, and ferrite 54, and a permanent magnet 3 and a resin case 7. The port portions P1 and P2 of the central conductors 51 and 52 are connected to input/output terminals 71 and 72 formed within the resin case 7, and matching capacitors C1 and C2, the port portion P3 of the central conductor 53 is connected to the matching capacitor C3 and a terminal resistor R, and the matching capacitors C1, C2, and C3 and the terminal resistor R at one end are connected to the ground 73.

In the equivalent circuit shown in FIG. 9, the ferrite is represented having the shape of a disc, the DC magnetic field is denoted by H, and the central conductors 51, 52, and 53 are represented as equivalent inductors L. Due to such a circuit configuration, the forward direction properties have band-pass filter properties, and even signals in the forward direction are somewhat attenuated at frequency bands farther away from the pass band.

Now, in normal communication devices, amplifiers used in the circuit always generate a certain level of distortion, which generates spurious waves such as second and third harmonic frequencies of the fundamental frequency, leading to unwanted radiation. Unwanted radiation of communication devices lead to abnormal actions of electric power amplifiers and interference, so standards and stipulations are provided beforehand, and the radiation must be kept under a certain level. Using amplifiers with good linear properties is effective for preventing unwanted radiation, but these are expensive, so filters are generally used instead to cause attenuation of unnecessary frequency components. However, such filters also increase costs and increase the device size, and further, there is loss due to the filters.

Thus, an arrangement can be conceived wherein the band-pass filter properties of isolators and circulators are used to suppress spurious components, but with a nonreciprocal circuit device having only the basic conventional configuration shown in FIGS. 7 through 9, sufficient attenuation characteristics have not been obtained at unnecessary frequency bandwidths.

A nonreciprocal circuit device which solves this problem and enables great attenuation amounts to be obtained at spurious frequency bandwidths such as twofold or threefold waves of the basic wave is disclosed in Japanese Unexamined Patent Application Publication No. 10-93308. An isolator which is an example of this nonreciprocal circuit device is shown in FIGS. 10 through 12. FIG. 10 is a exploded perspective view of the isolator, FIG. 11 is the internal structure thereof, and FIG. 12 is an equivalent circuit.

This isolator differs from the isolator described above with reference to FIGS. 7 through 9 in that an inductor Lf is provided for a band-pass filter. This inductor Lf is connected between the port portion P1 of the central conductor 51 and the matching capacitor C1 and the input/output terminal 71. A solenoid coil suitable for miniaturization is used for the inductor, and in the case of a 900 MHz band isolator, an item with approximately 24 nH inductance is used. Specifically, an article wherein a copper wire having a diameter of 0.1 mm is wound nine turns on an external diameter of 0.8 mm, is used.

Serially connecting a capacitor Cf to the input/output terminal 71 of an isolator, a band-bass filter is formed by the capacitor Cf and the inductor Lf as shown in FIG. 12, so signals of frequencies away from the pass band can be attenuated.

FIG. 13 is a diagram illustrating the frequency properties of the isolator shown in FIGS. 7 through 9 (first conventional example) and the isolator for a 900 MHz band, and it can be understood that the second harmonic frequency (1800 MHz) attenuation amount has been improved from 19.3 dB to 28.3 dB in comparing the second conventional example with the first conventional example, and the third harmonic frequency (2700 MHz) attenuation amount has been improved from 28.6 dB to 40.1 dB.

Thus, a filter for attenuating unnecessary frequency bandwidth constituted by providing an inductor within a nonreciprocal circuit device allows the overall circuit to be reduced in size as compared with providing an individual filter outside.

However, the recent demand for further miniaturization of mobile communication devices is necessitating further reduction in size of nonreciprocal circuit devices with inductors serving as filters, and accordingly, such inductors serving as filters must be reduced in size as well. However, in the event of reducing the size of inductors formed as solenoids, the inductance thereof becomes small, and the amount of attenuation at twofold and threefold waves of the basic wave becomes small. Also, a structure wherein a solenoid is formed within the magnetic body in order to reduce the size of the solenoid-shaped inductor without loosing inductance has been conceived, but such a structure requires a new magnetic body, of which the manufacturing process is not easy, and this is problematic since it would lead to increased costs.

SUMMARY OF THE INVENTION

Accordingly, it is an object of the present invention to provide a small nonreciprocal circuit device wherein great amount of attenuation can be obtained at a particular frequency band, without increasing costs, and to provide a communication device using this nonreciprocal circuit device.

The nonreciprocal circuit device according to the present invention comprises a magnetic body to which direct current magnetic field is applied, the magnetic body including a plurality of central conductors arranged to intersect one another, wherein series resonant circuits having a resonance frequency of a greater frequency than the center frequency of the pass bandwidth of the nonreciprocal circuit device are disposed between a ground and two or more of the central conductors, and wherein the resonance frequency of at least one of the series resonant circuits differs from that of the others.

The primary problematic spurious component with communication devices is that with a frequency higher than the basic wave frequency. Accordingly, connecting series resonant circuits having a resonance frequency higher than the center frequency of the pass band of the nonreciprocal circuit device (which will hereafter be referred to as "basic wave frequency") between the central conductors and the ground as a trap filter causes spurious signals with frequencies higher than the basic wave frequency to flow to the ground through the series resonant circuits, thereby attenuating spurious components propagated by the signal lines. Further, by making the resonance frequencies of the plural series resonant circuits different, the spurious component of a wide frequency bandwidth or at plural frequency bands is attenuated.

Generally, resonant circuits can be reduced in size as the resonance frequency becomes higher, so the configuration of the present invention wherein resonating with spurious components of frequencies higher than the center frequency and selectively attenuating them allows the circuit size to be reduced as compared with conventional nonreciprocal circuit devices such as shown in FIGS. 10 through 12 for resonating with and selectively passing the center frequency on the signal lines.

With the present invention, of the plurality of series resonant circuits, at least one of the series resonant circuits may have a resonance frequency that is substantially twice that of the frequency of the basic wave, and further, at least another of the series resonant circuits may have a resonance frequency that is substantially three times that of the frequency of the basic wave.

The most marked of unwanted radiation which is problematic with communication devices is spurious components of twofold and threefold waves having frequencies twofold and threefold of the basic wave frequency. Accordingly, of the plurality of series resonant circuits, at least one has a resonance frequency that is substantially twice that of the basic wave frequency, and at least another has a resonance frequency that is substantially three times that of the basic wave frequency. Thus, the twofold and threefold waves which are the most marked unwanted radiation can be attenuated efficiently. Note that with regard to the present invention, the term "substantially twice" means a range of around 1.5 times to 2.5 times, and the term "substantially three times" means a range of around 2.5 times to 3.5 times.

With the present invention, the inductors of the series resonant circuits may be formed by extending the port portions of the central conductors.

As described above, the resonance frequencies of the series resonant circuits have been set higher than the basic wave frequency, so the inductor can be miniaturized, and sufficient inductance can be obtained by extending the port portion of central conductors and bending it or suitably working the central conductors, even without adding extra components such as solenoid conductors, for example. Accordingly, the number of component parts of the nonreciprocal circuit device can be reduced, so the manufacturing process can be simplified and costs can be reduced.

With the present invention, the equivalent capacitance of the series resonant circuits at the center frequency may set to be a matching capacitance as to the center frequency.

The resonance frequencies of the series resonant circuits are set to be higher than the center frequency, thus forming capacitive impedance to the center frequency. By designing the inductors and capacitors of the series resonant circuits appropriately, the equivalent capacitance of the series resonant circuits is set as the equivalent matching capacitance to the center frequency. Thus, there is no need to provide other matching capacitors even in the event that series resonant circuits are provided as trap filters, thereby suppressing increasing in the number of parts, and contributing to reduction in costs.

Further, the present invention is a communication device comprising the above nonreciprocal circuit devices as circulators for performing branching of transmission signals and reception signals, for example. Thus, a communication device small in size and having good spurious properties, can be realized.

BRIEF DESCRIPTION OF THE DRAWINGS

FIG. 2 is a plan view of the above isolator with the upper yoke removed;

FIG. 3 is an equivalent circuit diagram of the above isolator;

FIG. 4 is a diagram illustrating the frequency properties of the reduction amount of the above isolator and a conventional isolator;

FIG. 11 is a plan and cross-sectional view of the above isolator with the upper yoke removed;

FIG. 12 is an equivalent circuit of the above isolator; and

FIG. 13 is a diagram illustrating the frequency properties of the attenuation amount for the above two conventional isolators.

DESCRIPTION OF THE PREFERRED EMBODIMENTS

The configuration of an isolator according to an embodiment of the present invention will be described, with reference to FIGS. 1 through 3.

Figure 1:
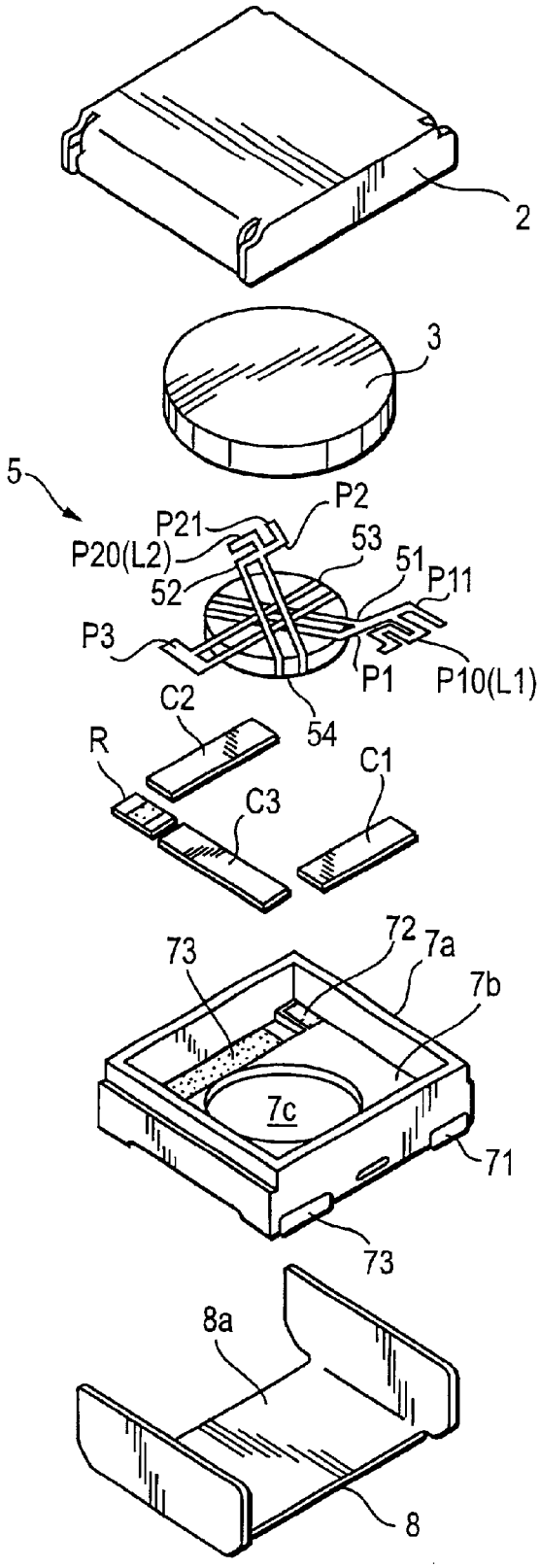
FIG. 1 is a exploded perspective view of an isolator according to a first embodiment.

FIG. 1 is an exploded perspective view of an isolator, FIG. 2 is a plan view thereof with the upper yoke removed. As can be understood from FIGS. 1 and 2, this isolator has a disc-shaped permanent magnet 3 arranged on the inner side of a box-shaped upper yoke 2 made of a magnetic metal, and a magnetic closed circuit is constituted by the upper yoke 2 and a lower yoke 8 which is also made of a magnetic metal and has an approximate shape of a box with one end opened, a resin case 7 is provided on the bottom surface 8*a* inside of the lower yoke 8, and a magnetic assembly 5, matching capacitors C1, C2, and C3 and a terminal resistor R are arranged within the resin case 7.

The above magnetic assembly 5 has the following configuration. Three central conductors 51, 52, and 53 have a shared ground portion. The bottom surface of a rectangle-shaped plate ferrite 54 is brought into contact with the shared ground portion having the same shape as the bottom surface of the ferrite 54. The three central conductors 51, 52, and 53 extending from the shared ground portion are bent to define an angle of 120 degrees one with another, and are arranged on the upper face of the ferrite 54 with insulating sheets (not shown) interposed therebetween. The port portions P1, P2, and P3 at the tip side of the central conductors 51, 52, and 53 protrude outwards. A DC magnetic field is applied to this magnetic assembly 5 by the permanent magnet 3, so that magnetic flux will pass through the ferrite 54 in the thickness direction thereof.

The resin case 7 is formed of an electrically insulating material, with rectangular walls 7*a* and a bottom wall 7*b* being integrally formed, having input/output terminals 71 and 72 and ground terminals 73 partially embedded in the resin. The center portion of the bottom wall 7*b* has a insertion hole 7*c* formed therein, and the magnetic assembly 5 is inserted within this insertion hole 7*c* and thus arranged. The ground portion of the central conductors 51, 52, and 53 at the lower face of the magnetic assembly 5 is connected to the bottom surface 8*a* of the lower yoke 8 by soldering or the like. The input/output terminals 71 and 72 are provided at the corner portions of one side wall of the resin case 7, and the ground terminals 73 are formed at the corner portions of the other side wall. One of the ends of each of the input/output terminals 71 and 72 and the ground terminals 73 is exposed on the upper face of the bottom wall 7*b*, and the other ends of each exposed on the lower face of the bottom wall 7*b* and on the outer surface of the side wall 7*a*.

Chip-shaped matching capacitors C1, C2, C3, and a chip-shaped terminal resistor R are provided around the insertion hole 7*c*. The lower face electrodes of the capacitors C1, C2, C3, and an electrode at one end of the terminal resistor R are connected to the ground terminals 73.

The port portion P3 of the central conductor 53 is connected to the upper face electrodes of the capacitor C3, and an electrode at the other end of the terminal resistor R. The port portions P1 and P2 of the central conductors 51 and 52 are each branched into P10 and P11, and P20 and P21, with the branch P10 of the port portion P1 being extended in a meandering line shape so as to form an inductor L1, which is connected to the upper face electrode of the capacitor C1. Also, the branch P20 of the port portion P2 is bent and extended so as to form an inductor L2, and is connected to the upper face electrode of the capacitor C2. Further, the other branches P11 and P21 of the port portions P1 and P2 are each connected to the input/output terminals 71 and 72.

Note that the port portions P1, P2, and P3 are formed in a stepped shape, such that the port portions P1, P2, and P3 are of the same height on the upper face of the capacitors C1, C2, and C3.

FIG. 3 is an equivalent circuit diagram of the above isolator. By connecting in the above-described manner, a series resonant circuit including L1 and C1 is formed as a trap filter between the input/output terminal 71 and ground (ground terminal 73), and of the signals input from the input/output terminal 71 or the central conductor 51, the components near the resonance frequency of the series resonant circuit are shunted to the ground by this trap filter, where they are greatly attenuated. Also, in the same manner, a series resonant circuit including L2 and C2 is formed as a trap filter between the input/output terminal 72 and ground (ground terminal 73), and of the signals input from the input/output terminal 72 or the central conductor 52, the components near the resonance frequency of the series resonant circuit are shunted to the ground by this trap filter, where they are greatly attenuated. Note that each inductance L in the figure is an equivalent inductance formed of the central conductors 51, 52, 53, and the ferrite 54.

Also, since the series resonant circuit formed of L1 and C1 and the series resonant circuit formed of L2 and C2 have resonance frequencies higher than the center frequency of the pass band of the nonreciprocal circuit device (i.e., the basic wave frequency), the series resonant circuits exhibit capacitive impedance to the center frequency of the pass band, and thus constitute a matching circuit with the above-described inductance L.

Now, in the event of applying the isolator according to the present embodiment to a 900 MHz band, the above inductor L1 is formed having a width of 0.2 mm and a length of 2 mm so as to obtain inductance of 1.1 nH, and the inductor L2 is formed having a width of 0.2 mm and a length of 0.7 mm so as to obtain inductance of 0.4 nH. The capacitors C1 and C2 are each set to 6.7 pF and 8.0 pF. According to such a configuration, the resonance frequency of the series resonant circuit including L1 and C1 is 1.9 GHz, and the resonance frequency of the series resonant circuit including L2 and C2 is 2.8 GHz, and thus can function as trap filters for twofold wave and threefold wave of 900 MHz. Both the series resonant circuit including L1 and C1 and the series resonant circuit including L2 and C2 have a equivalent capacitance of approximately 9 pF as to 900 MHz, and thus can function as matching capacitance as to 900 MHz signals.

Figure 7:
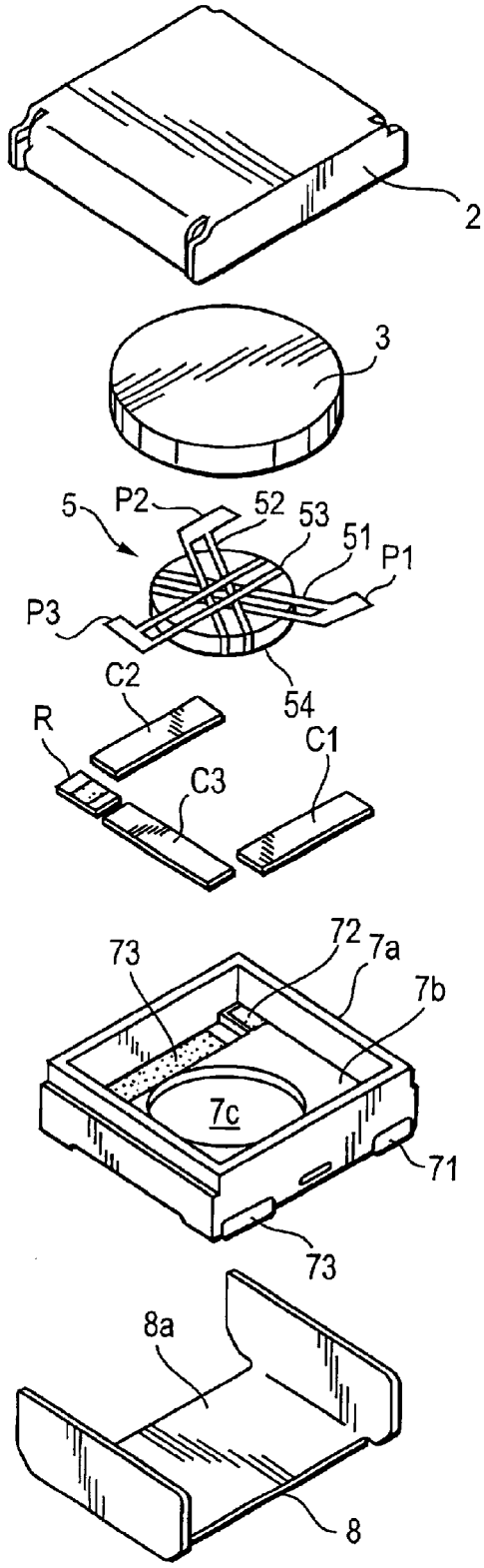
FIG. 7 PRIOR ART
FIG. 7 is an exploded perspective view of a conventional isolator.
Figure 8:
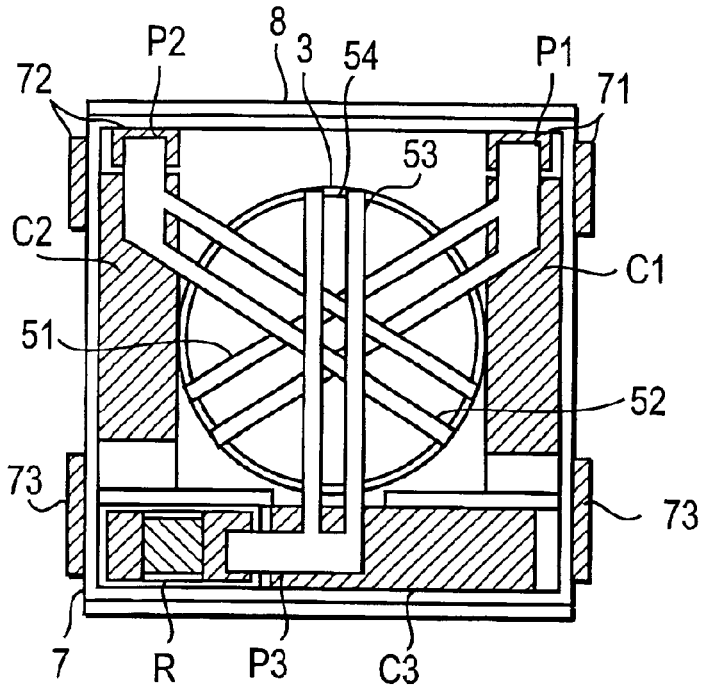
FIG. 8 PRIOR ART
FIG. 8 is a plan and cross-sectional view of the above isolator with the upper yoke removed.
Figure 9:
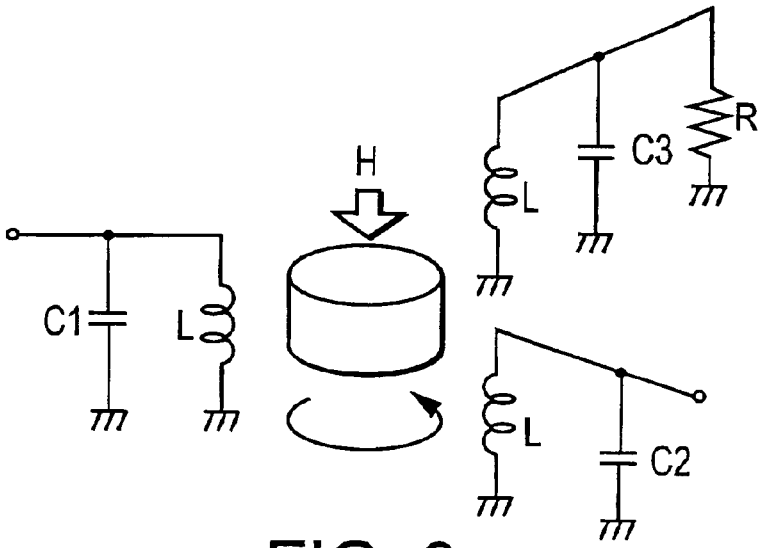
FIG. 9 PRIOR ART
FIG. 9 is an equivalent circuit diagram of the above isolator.
Figure 10:
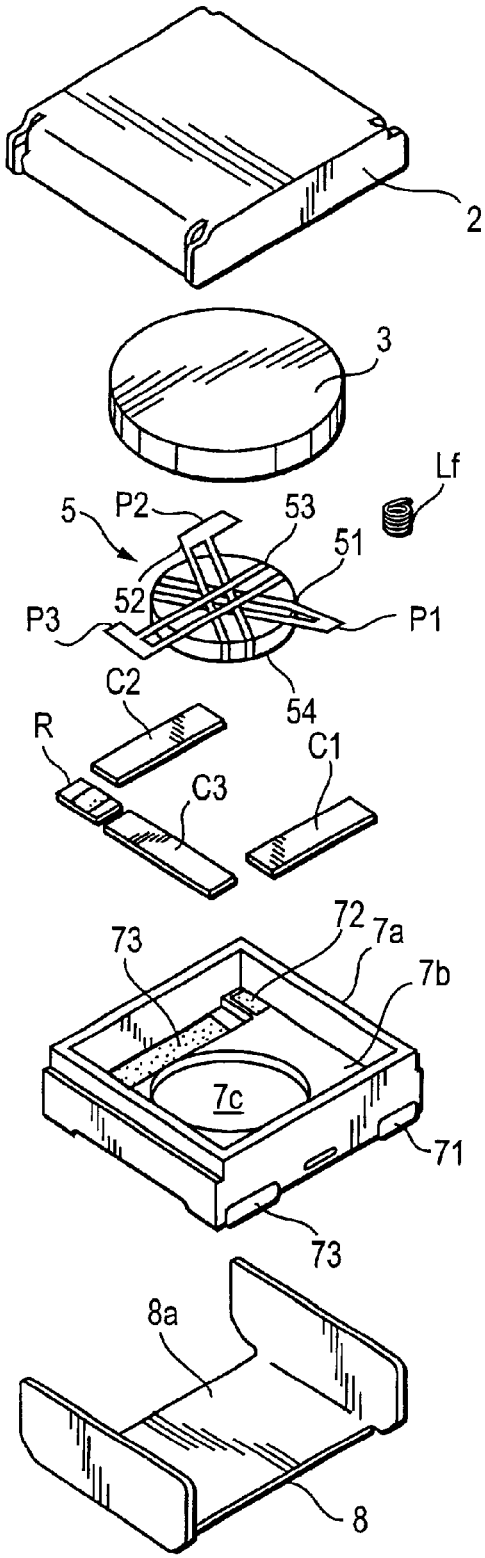
FIG. 10 PRIOR ART
FIG. 10 is an exploded perspective view of another conventional isolator.

FIG. 4 illustrates attenuation characteristics of the above isolator in the propagation-direction applied to the 900 MHz band. In the figure, the solid line represents the isolator properties of the present embodiment, and the broken line represents the isolator properties of a conventional isolator of FIGS. 7 through 9 applied to the 900 MHz band. When the basic wave frequency is 900 MHz, with the conventional example not provided with the trap filter formed of the above series resonant circuit, the attenuation amount of twofold wave frequency was approximately 19 dB and that of threefold wave frequency was approximately 28 dB, while with the present embodiment, the attenuation amount of twofold wave frequency was approximately 28 dB and that of threefold wave frequency was approximately 63 dB, thus yielding great attenuation amount.

Figure 5:
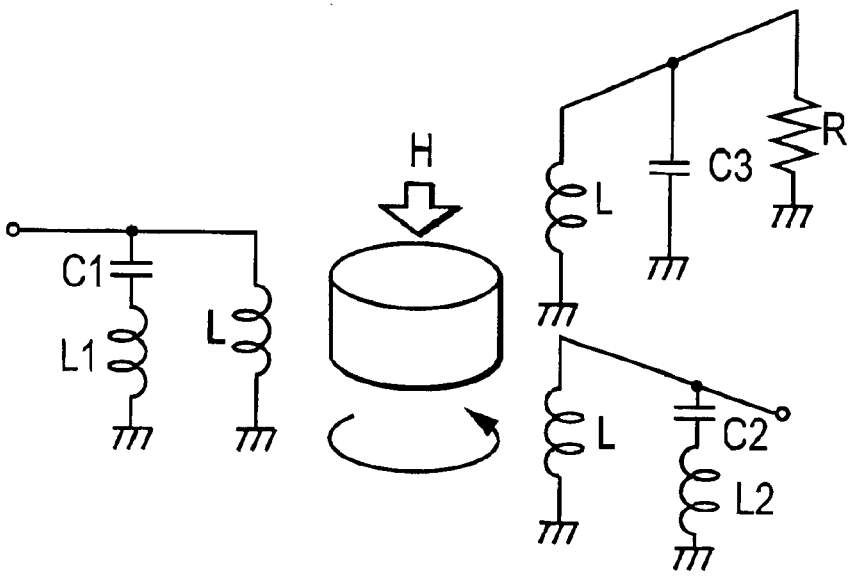
FIG. 5 is an equivalent circuit diagram of an isolator according to a second embodiment.

While the present embodiment is described with the port portions of the central conductors being branched and extended to form inductors, inductors may be formed using a dielectric substrate or magnetic substrate and forming electrodes within or on the surface thereof. Also, parts such as chip inductors, hollow-core coils, etc., may be used as well. In this case, inductors may be connected to the ground side to form series resonant circuits, as with the equivalent circuit diagram in FIG. 5.

Also, according to the present embodiment, two resonant circuits resonate in the vicinity of frequencies of twofold waves and threefold waves, but the resonance frequencies are not restricted to this.

Also, though the present embodiment has been described with an example of an isolator, but the present invention can also be applied to a circulator wherein the terminal resistor R is not connected to the port portion P3 of the third central conductor, with the port portion P3 formed as a third input/output portion. In this case, the port portion P3 may have the configuration of being connected to a trap filter constituted by a series resonant circuit as is similar with the port portions P1 and P2, or the port portion P3 may be directly connected to the capacitor C3 and input/output terminal.

Also, in the case of providing the port portion P3 with a series resonant circuit, the resonance frequency of this series resonant circuit may be set to be the same resonance frequency of that of either the port portion P1 or the port portion P2, or may be set to be a different third resonance frequency.

The signals input from the input/output terminals of the circulator pass through two of the port portions of the three port portions, i.e., the port portion of the terminal to which the signals are input and the port portion of the terminal to which the signals are output. At this time the series resonant circuits at the two port portions through which the signals pass act as trap filters for the signals. Accordingly, in the case that different signals pass through the paths of the circulator, the spurious component of each of the signals can be efficiently removed by setting resonance frequencies appropriate to the three series resonant circuit according to the basic frequency and spurious components of the signals passing through the respective paths.

Further, overall structure of the nonreciprocal circuit device according to the present invention is by no means restricted to the arrangement shown in FIGS. 1 and 2, and a construction wherein central conductors are formed within a laminated substrate, for example, may be used.

Figure 6:
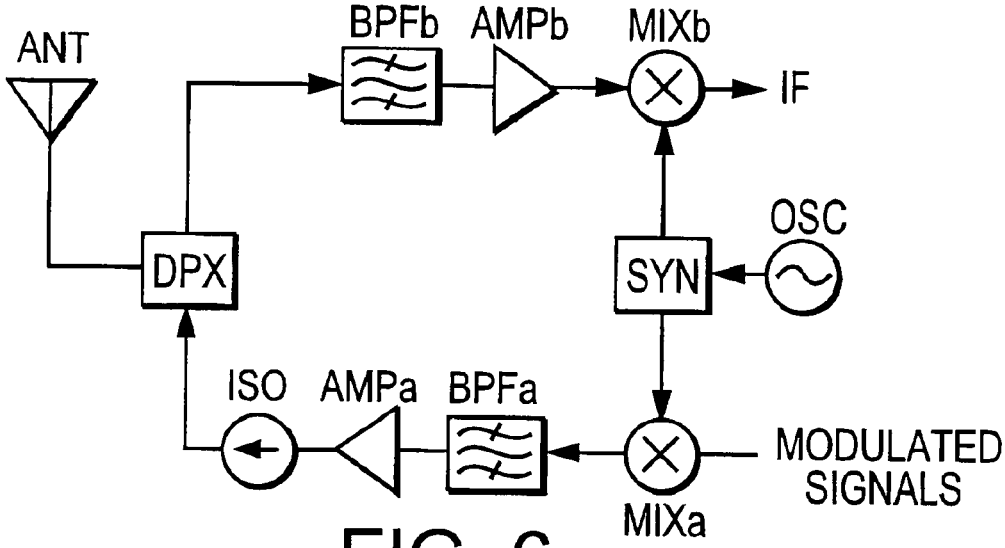
FIG. 6 is a block diagram illustrating the configuration of a communication device according to a third embodiment.

Next, an example of a communication device using the above isolator will be described with reference to FIG. 6. In the figure, ANT denotes a transmitting/receiving antenna, DPX denotes a duplexer, BPFa, BPFb, and BPFc each denote band-pass filters, AMPa and AMPb each denote amplifier circuits, MIXa and MIXb each denote mixers, OSC denotes an oscillator, and SYN denotes a frequency synthesizer. The MIXa modulates the frequency signals supplied from the SYN with modulating signals, the BPFa passes only the transmitting frequency bandwidth, the AMPa subjects this to power amplification, and the signals are transmitted from the ANT via the isolator ISO and the DPX. The BPFb passes only the receiving frequency bandwidth of the signals supplied from the DPX, which is amplified by the AMPb. The MIXb mixes the frequency signals supplied from the SYN and the reception signals, so as to output intermediate frequency signals IF.

The device shown in FIGS. 1 through 5 and described herein is used as the above isolator ISO. This isolator ISO has band elimination characteristics or low-pass characteristics as well, so the band-pass filter BPFa which passes only transmitting frequency bandwidth can be omitted. Thus, the overall communication device can be constructed with a small size.

According to the present invention, series resonant circuits having a resonance frequency of a higher frequency than the center frequency of the pass bandwidth are provided between the central conductors and the ground terminal, so spurious components which tend to occur at frequencies higher than the basic frequency can be effectively attenuated. Also, setting the resonance frequencies high allows the inductors and capacitors to be reduced in size, thereby contributing to reduction in the size of the device. Further, series resonant circuits have been provided to plural central conductors, thereby increasing the rate of attenuation of unwanted radiation of particular frequencies, and also, unwanted radiation can be attenuated over a wide bandwidth.

Also, setting the resonance frequency of plural series resonant circuits to approximately twice and approximately three times of that of the basic wave frequency allows the twofold waves and threefold waves which are spurious components with great signal levels to be markedly reduced.

Also, the inductors of the series resonant circuits can be formed as part of the central conductors, so the number of parts can be reduced, thereby contributing to simplification in the manufacturing process, reduction in size, and reduced costs.

With the present invention, the series resonant circuits can be used as matching capacitance of the matching circuit, so there is no need to provide an extra matching capacitance, thereby contributing to simplification in the manufacturing process, reduction in size, and reduced costs.

Further, according to a second aspect of the present invention, reduction in size can be realized while improving spurious properties and suppressing unwanted radiation from the device.

What is claimed is:

1. A nonreciprocal circuit device comprising:

a magnetic body for receiving a direct current magnetic field and including a plurality of central conductors arranged to intersect one another; and only two series resonant circuits having a resonance frequency greater than the center frequency of the pass bandwidth of said nonreciprocal circuit device so that an equivalent capacitance of the only two series resonant circuits is a matching capacitance of the center frequency; wherein one of the only two series resonant circuits is disposed between a ground and an input port;

the other one of the only two series resonant circuits is disposed between the ground and an output port; and the resonance frequency of one of the only two series resonant circuits differs from the resonance frequency of the other one of the only two series resonant circuits.

2. A nonreciprocal circuit device according to claim 1, wherein one of the only two series resonant circuits has a resonance frequency that is substantially twice that of the center frequency of the pass bandwidth and the other one of the only two series resonant circuits has a resonance frequency that is substantially three times that of the center frequency of the pass bandwidth.

3. A nonreciprocal circuit device according to claim 2, wherein at least one of the only two series resonant circuits includes an inductor which is formed by extending a port portion of at least one of the plurality of central conductors.

4. A nonreciprocal circuit device according to claim 1, wherein at least one of the only two series resonant circuits includes an inductor which is formed by extending a port portion of at least one of said plurality of central conductors.

5. A communication device comprising:

the nonreciprocal circuit device according to any one of the claims 1, 2, 3, and 4; and at least one of a transmitting circuit and a receiving circuit connected to said nonreciprocal circuit device.

* * * * *